US007371999B1

(12) United States Patent
Douglas et al.

(10) Patent No.: US 7,371,999 B1
(45) Date of Patent: May 13, 2008

(54) TEMPERATURE CHANGING APPARATUS HAVING A ROTATING AIR DEFLECTOR

(75) Inventors: Scott L. Douglas, Germantown, WI (US); Lawrence G. Banovez, Kenosha, WI (US); William J. Hansen, Pewaukee, WI (US)

(73) Assignee: Alto-Shaam, Inc., Menomonee Falls, WI (US)

( * ) Notice: Subject to any disclaimer, the term of this patent is extended or adjusted under 35 U.S.C. 154(b) by 0 days.

(21) Appl. No.: 11/542,369

(22) Filed: Oct. 3, 2006

(51) Int. Cl.
*A21B 1/00* (2006.01)
*F24C 15/32* (2006.01)

(52) U.S. Cl. ..... 219/399; 219/400; 126/21 A; 432/176; 432/194

(58) Field of Classification Search ..... 219/399, 219/400; 126/21 A; 432/176, 194
See application file for complete search history.

(56) References Cited

U.S. PATENT DOCUMENTS

| | | | | |
|---|---|---|---|---|
| 1,244,480 | A | | 10/1917 | Dieterich |
| 3,818,813 | A | | 6/1974 | Freeman |
| 4,516,012 | A | * | 5/1985 | Smith et al. ..... 219/400 |
| 4,757,800 | A | * | 7/1988 | Shei et al. ..... 126/21 A |
| 4,817,509 | A | | 4/1989 | Erickson |
| 6,188,045 | B1 | | 2/2001 | Hansen et al. |
| 6,608,288 | B2 | | 8/2003 | Maahs |

* cited by examiner

*Primary Examiner*—Shawntina Fuqua
(74) *Attorney, Agent, or Firm*—Quarles & Brady LLP

(57) ABSTRACT

A temperature changing apparatus including a chamber defining a cavity is configured to receive a food product therein. A radially exhausting fan disposed in the cavity circulates air in the cavity over the food product. An air deflector disrupts the air radially exhausted from the fan.

20 Claims, 7 Drawing Sheets

TEMPERATURE CHANGING APPARATUS HAVING A ROTATING AIR DEFLECTOR

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates generally to a temperature changing apparatus, and in particular, relates to a temperature changing apparatus having an air mover, such as convection ovens, refrigerators, and freezers.

2. Description of the Related Art

A temperature changing apparatus, such as a convection oven, is used in the food industry to change the temperature of a food product as part of preparing the food for consumption. Convection ovens are provided as stand alone units or in combination with other food preparation mechanisms, such as steamers, in combination oven/steamers, such as those commercially available from Alto-Shaam®, Inc, located in Menomomee Falls, Wis. These combination devices include, in particular, Combitherm® Combination Oven/Steamers available from Alto-Shaam®, Inc., which utilize steam, heated air or a combination of both for steaming, baking, roasting, thawing, reheating, and various other cooking functions. These convection ovens are commercially available as gas and electric models.

Convection ovens decrease cooking time of food products by blowing heated air over a food product. The convection current caused by the moving heated air continuously strips away a cold boundary layer surrounding the food product and cooks the food product faster compared to a convention oven in which the air is static.

Known convection ovens, and other temperature changing apparatus, incorporate a centrifugal fan, or blower wheel, that continuously moves the air surrounding the food product in the oven to create the heated convection current. The centrifugal fan creates a flow pattern around the food product in the oven forming high and low pressure areas that are substantially static (i.e. the pressure areas do not move within the oven). As a result, different shaped food products and placement of the food product in the oven may affect the cooking time and result in uneven heating, an even uneven browning, of the food product. In the case of a refrigeration unit, the static pressure areas can affect the cooling and/or freezing time resulting in uneven cooling of the food product.

In order to overcome this problem, a static air baffle enclosing the centrifugal fan is often used. The static air baffle is often configured to produce a substantially laminar flow through the oven for cooking. Unfortunately, the baffle merely shapes the airflow to minimize the undesirable pressure areas for heating specifically shaped and placed food products. In particular, the baffle can be configured to direct laminar airflow equally along every shelf position in the oven for a low profile food product, such as a pan of cookies. Unfortunately, this same airflow would be unsatisfactory for another product, such as a sub roll or chicken breast, in the same oven.

In another attempt to disrupt the pressure areas in conventional convection ovens, some manufacturers intermittently stop and reverse the centrifugal fan. Stopping and reversing the centrifugal fan every few minutes reverse the air flow in the oven every few minutes and temporarily relocates the pressures areas. The pressure areas are only temporarily relocated because once the fan reaches its design speed, the location of the pressure areas is substantially the same regardless of the rotation direction of the fan. Unfortunately, stopping and reversing the centrifugal fan can create excessive noise and cause premature failure of the fan. Accordingly, this solution is less than desirable.

Therefore, a need exists for a convection oven that minimizes static pressure areas to efficiently and effectively heat a food product regardless of the food product shape or location in the oven.

BRIEF SUMMARY OF THE INVENTION

The present invention provides an temperature changing apparatus including a chamber defining a cavity that is configured to receive a food product therein. A radially exhausting fan disposed in the cavity circulates air in the cavity. An air deflector disrupts the air radially exhausted from the fan.

A general objective of the present invention is to provide a temperature changing apparatus that minimizes static pressure areas to efficiently and effectively change the temperature of a food product regardless of the food product shape or location in the cavity. This objective is accomplished by including a centrifugal fan with an air deflector that continuously disrupts the air radially exhausted from the fan. The continuously disrupted air cannot form an constant air flow pattern in the cavity and establish substantially static pressure areas in the cavity.

These and other aspects of the invention are not intended to define the scope of the invention for which purpose claims are provided. In the following description, reference is made to the accompanying drawings, which form a part hereof, and in which there is shown by way of illustration, and not limitation, preferred embodiments of the invention. Such embodiments do not define the scope of the invention and reference must be made therefore to the claims for this purpose.

BRIEF DESCRIPTION OF THE DRAWINGS

Reference is hereby made to the following figures in which like reference numerals correspond to like elements throughout, and in which.

DETAILED DESCRIPTION OF THE PREFERRED EMBODIMENT

Figure 1:
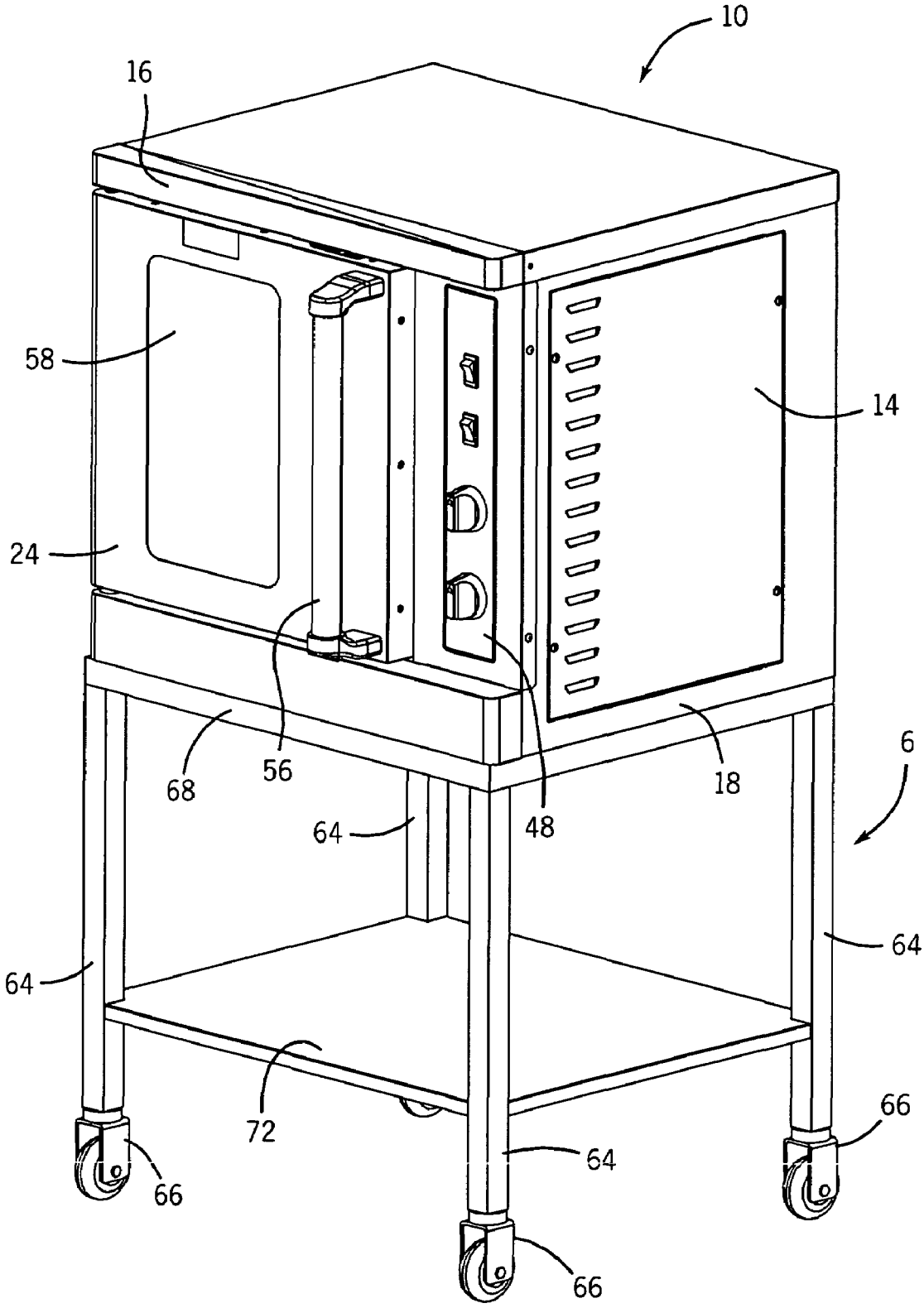
FIG. 1 is an front perspective view of an oven in accordance with a preferred embodiment of the invention.
Figure 2:
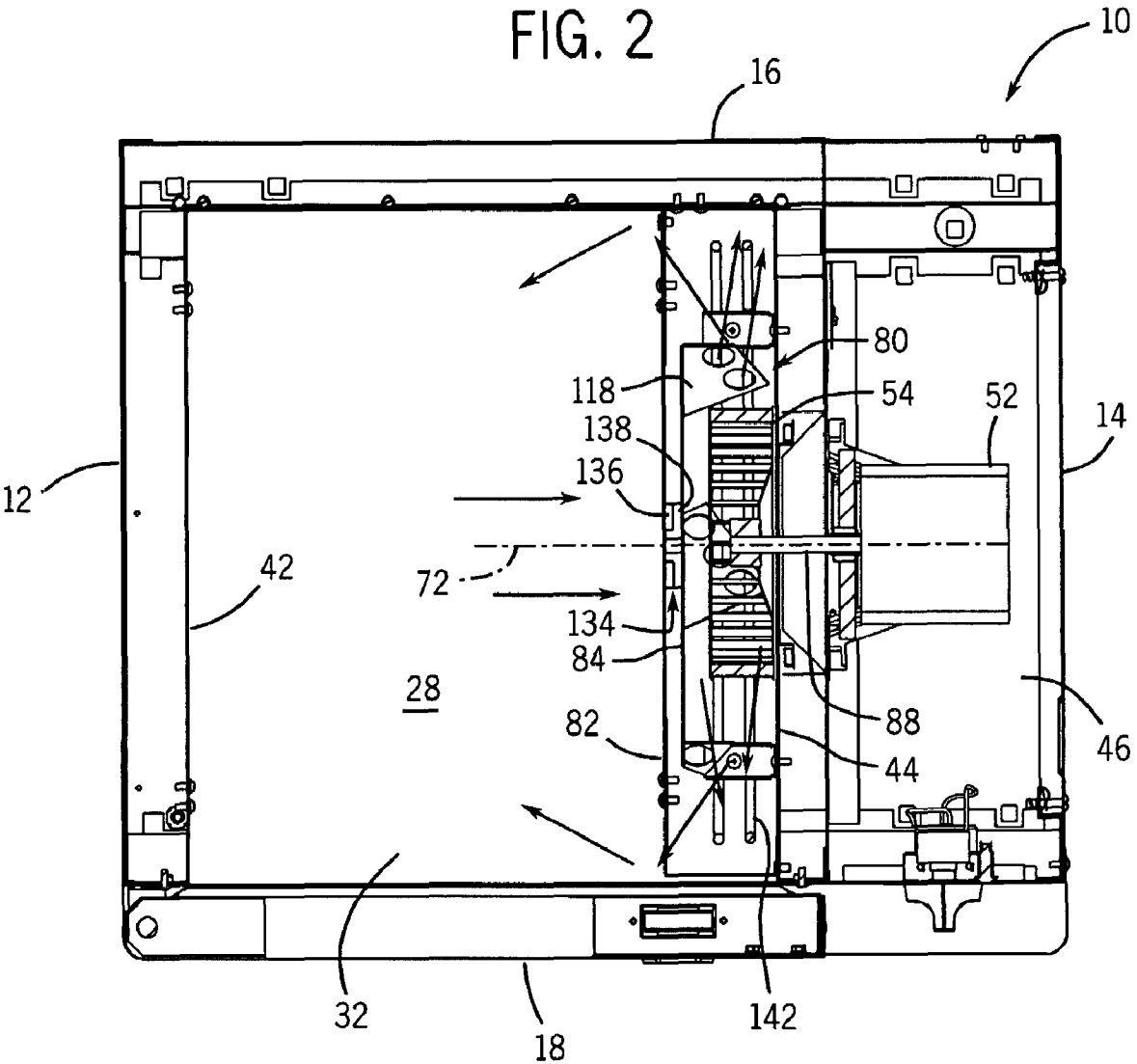
FIG. 2 is top cut away view of the oven of FIG. 1.

Referring initially to FIGS. 1 and 2, a temperature changing apparatus in the form of a commercial oven 10 includes a left side wall 12 and opposing right side wall 14 that are connected to their upper and lower ends by an upper wall 16 and a base 18. The side walls 12 and 14, upper wall 16, and base 18 are connected at their front and rear ends to a front end wall 22 (including a door 24) and rear end wall 26, respectively. The oven 10 encases a generally rectangular cooking chamber 28 whose interior defines a heating cavity 32.

The heating cavity 32 is generally defined by front and rear oven walls 36 and 38, respectively, and left side wall 12. The right end of heating cavity 32 is bound by an internal right cavity side wall 44 that extends parallel to the outer right side wall 14. The right cavity side wall 44 is offset from the outer right side wall 14 by a sufficient distance in order to provide a housing 46 for various oven controls and electronics 48, including among other things timer and temperature controls to operate a cooking sequence in accordance with the present invention, and a motor 52 which rotatably drives a centrifugal fan 54. The front end of heating cavity 32 is defined by the door 24 which is hingedly connected to the left side wall 12 and can be opened and closed via a traditional handle 56 to provide access to the heating cavity 32. A transparent panel 58 is embedded within the door 24 to enable visible access to the heating cavity 32 when the door 24 is closed. A plurality of racks 62 can be provided in the heating cavity 32 to support food product (not shown) being heated in the heating cavity 32.

The oven 10 can be supported by a support stand 60 including a plurality of vertical legs 64 that extend downwardly from the base 18 and terminate at feet 66 having rollers 74 mounted thereto. The rollers 74 rest on a surface, such as a kitchen floor, and allow the oven 10 to be easily moved on the floor. The support stand 60 further includes a plurality of upper rails 68 connecting the upper ends of the legs 64 proximal the base 18. A flat rectangular plate 72 can be connected to the lower ends of the legs 64 at a location slightly upwardly of the feet 66. The plate 72 and rails 68 enhance the stability of the support stand 60.

In accordance with the preferred embodiment, the oven 10 is a Combitherm® oven or stand alone convection oven, commercially available from Alto-Shaam, Inc. located in Menomonee Falls, Wis., including a fan assembly 80, such as described herein, that circulates heated air in the heating cavity 32. Such ovens are available in several models having cooking elements that may include electric coils or gas burners disposed within the heating cavity 32 to prepare the food product via convection.

As shown in FIG. 2, the fan assembly 80 is disposed in the heating cavity 32 and separated from the food product being cooked by a baffle 82. The centrifugal fan 54 and an air deflector 84 forming part of the fan assembly 80 continuously changes the air flow path in the heating cavity 32 while cooking the food product. Advantageously, continuously changing the air flow path in the heating cavity 32 evenly heats the food product in the heating cavity regardless of the food product shape and location in the heating cavity 32.

Figure 3:
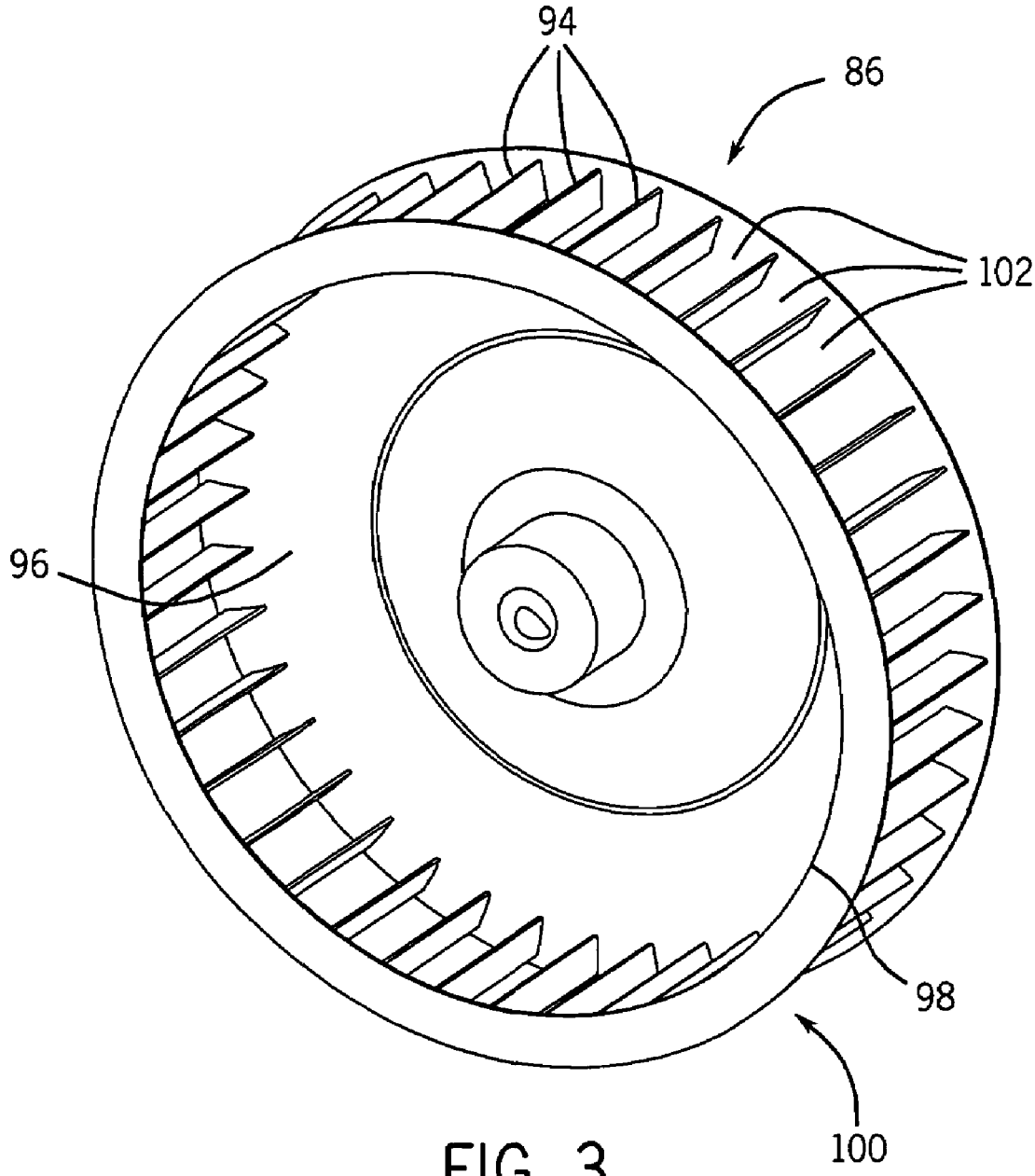
FIG. 3 is a front perspective view of centrifugal fan impellor of FIG. 2.

Referring to FIGS. 2 and 3, the centrifugal fan 54 includes an annular impellor 86 mounted on a rotatably driven shaft 88 extending into the heating cavity 32. The rotatably driven shaft 88 rotatably drives the impellor 86 about an axis of rotation coaxial with the shaft axis 92. In the embodiment disclosed herein, the shaft 88 is directly driven by the motor 52 disposed in the housing 46 at a speed of between about 250 and 3500 rpm, and preferably between about 500 and 1725 rpm. Of course, the shaft 88 and impellor 86, can be rotatably driven by any methods know in the art, such as by a belt, turbine, and the like, without departing from the scope of the invention.

The impellor 86 includes a plurality of blades 94 around its periphery. Rotation of the impellor 86 about the impellor axis of rotation centrifugally drives air from a center 96 of the annular impellor 86 radially outwardly. As a result, air is drawn axially into a fan inlet 98 formed at the center 96 of the annular impellor 86 and exhausted radially through gaps 102 between the blades 94 defining a fan outlet 100 at the impellor periphery.

Figure 4:
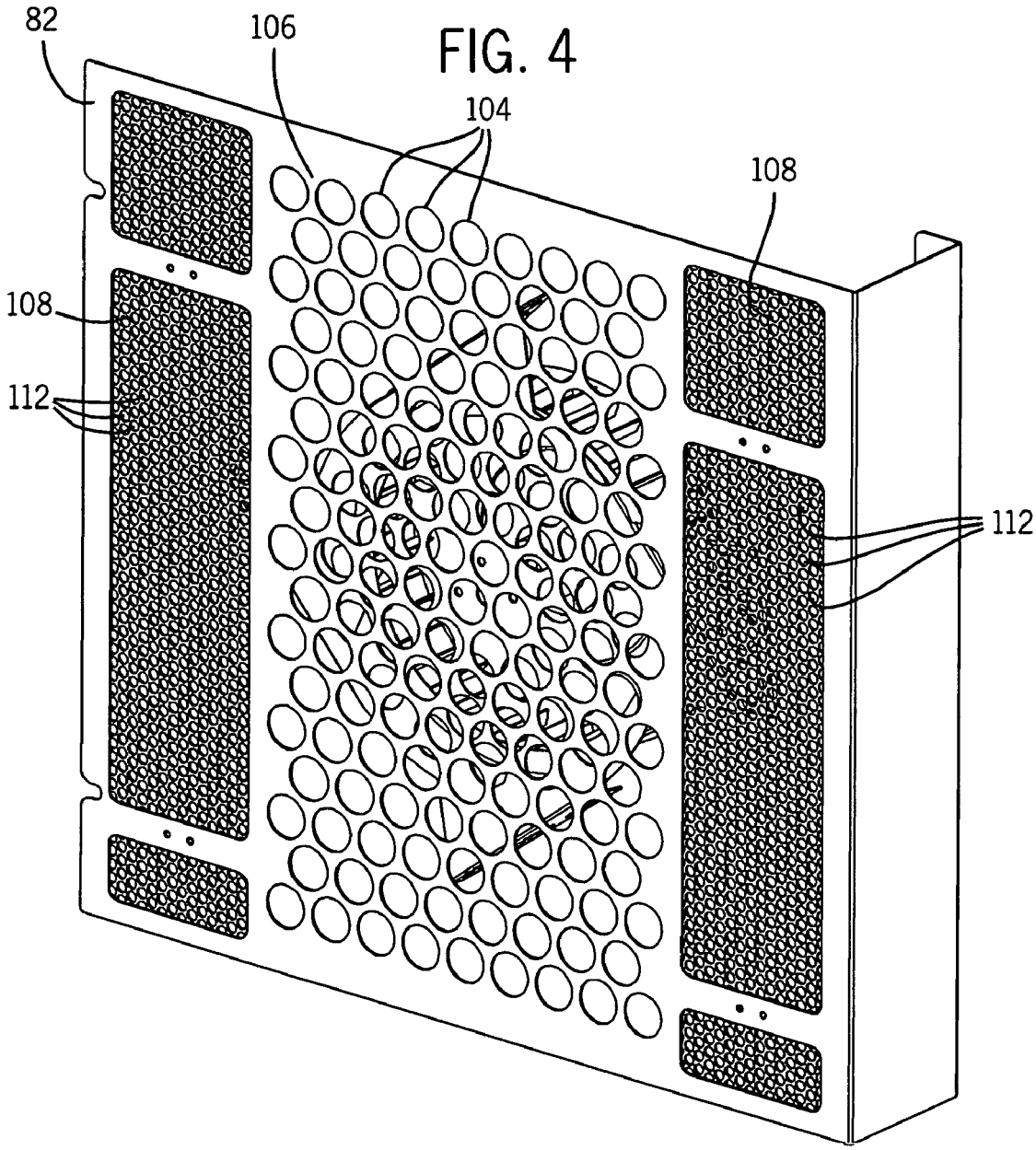
FIG. 4 is a front perspective view of the baffle of FIG. 2.
Figure 5:
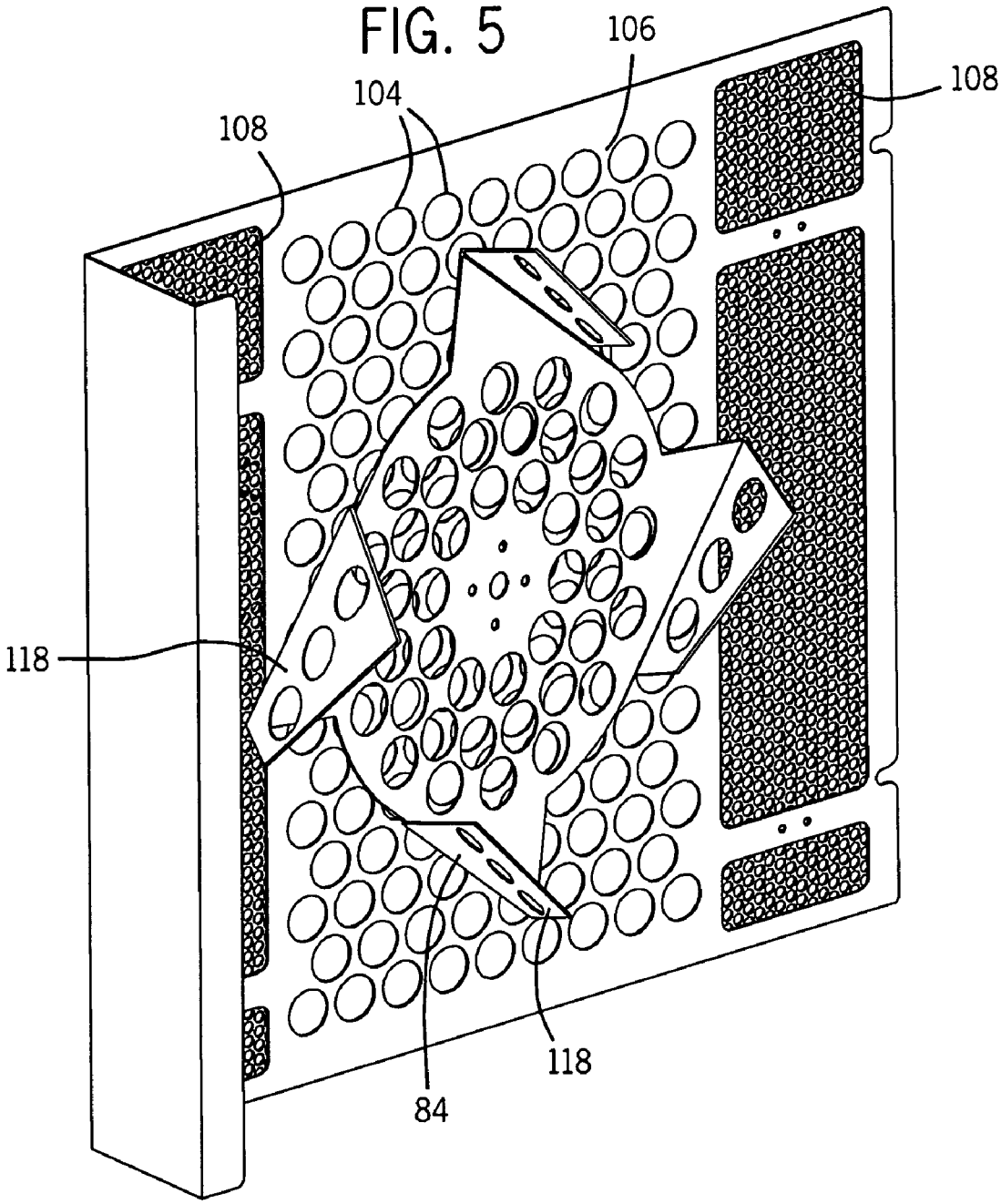
FIG. 5 is a rear perspective view of the of the baffle and air deflector shown in FIG. 2.
Figure 6:
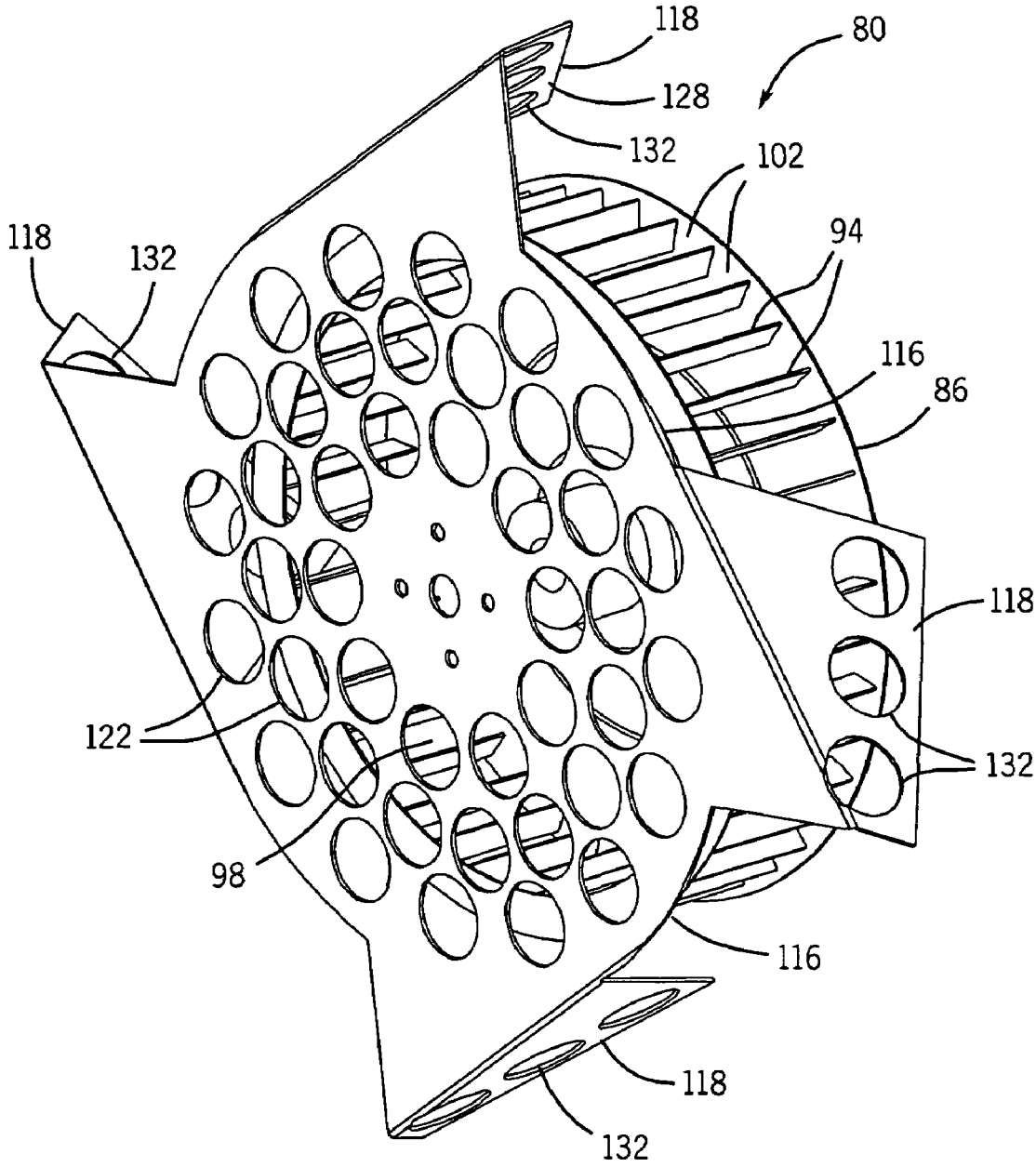
FIG. 6 is a front perspective view of the air deflector and impellor of FIG. 2.
Figure 7:
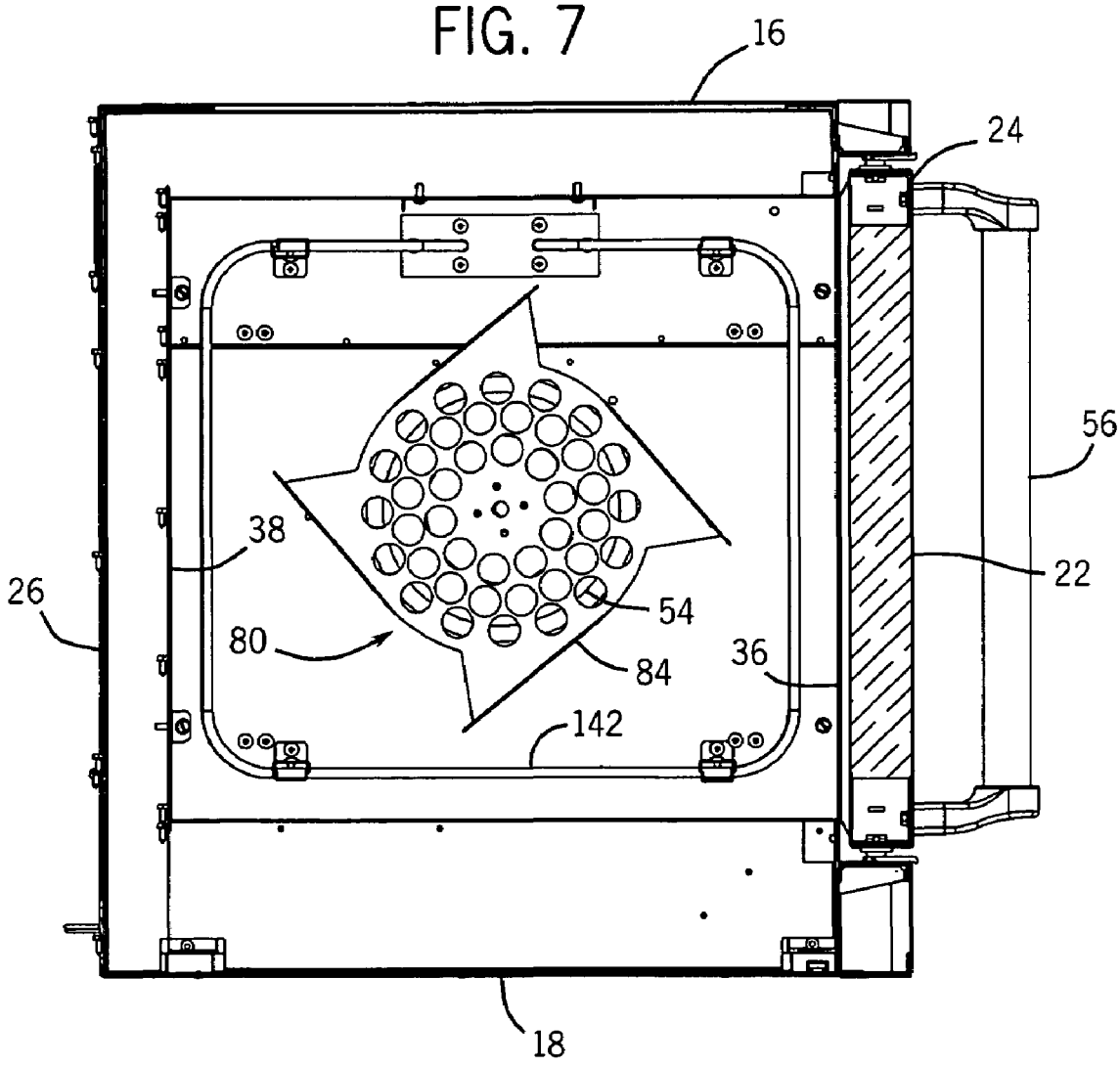
FIG. 7 is a front view of the fan assembly shown in FIG. 2 with the baffle removed.

As shown in FIGS. 2, 4, and 5, the baffle 82 is a removable panel disposed in the heating cavity 32 and separates the fan assembly 80 from the food product in the heating cavity 32. The baffle 82 includes an air inlet 106 defined by a plurality of openings 104 formed in the panel in front of the fan assembly 80 and fan inlet 98. Air in the heating cavity 32 surrounding the food product is drawn into the fan inlet 98 through the air inlet 106 by the centrifugal fan 54. Air outlets 108 defined by openings 112 formed in the baffle 82 adjacent the fan outlet 100 allow air exhausted by the fan 54 to pass through the baffle 82 and over the food product.

The air deflector 84 shown in FIGS. 2 and 5-7 is rotatably supported by the baffle 82 coaxially with the centrifugal fan 54 and moves over the fan outlet 100 to disrupt the air exhausted by the centrifugal fan 54 and prevent the formation of substantially static pressure areas in the heating cavity 32. The air deflector 84 includes a base 116 extending radially from an axis of rotation coaxial with the centrifugal fan impellor axis of rotation. Axially extending vanes 118 extend from the periphery of the base 116 over the fan outlet 100 to disrupt the air exhausted by the centrifugal fan 54.

The air deflector base 116 covers the fan inlet 98 and includes openings 122 defining an air deflector inlet 124 in front of the fan inlet 98. Air passing through baffle air inlet 106 is drawn into the fan inlet 98 through the air deflector inlet 124 by the centrifugal fan 54. The number and size of the openings 122 defining the air deflector inlet 124 depends upon the air volume required for the centrifugal fan 54.

The air deflector vanes 118 extend axially over the impellor periphery in the path of the air exhausted from the fan outlet 100. Each vane 118 include an impingement surface 128 extending substantially tangentially with respect to the impellor periphery. Air exhausting from the centrifugal fan outlet 100 impinges upon the impingement surface 128 to rotatably drive the air deflector 84 about the air deflector base axis of rotation. Although rotatably driving the air deflector 84 with air exhausting from the centrifugal fan 54 is preferred, the air deflector 84 can be rotatably driven using other methods known in the art, such as driving the air deflector with a motor, without departing from the scope of the invention.

The angle of the vanes 118 relative to the air exhausting from the centrifugal fan 54 determines the rotational speed and direction of the air deflector 84 and is dependent upon the volume and velocity of the air exhausting from the centrifugal fan 54. In the embodiment disclosed herein, the vanes 118 are configured to rotate the air deflector 84 in the same direction as the impellor 86 and at a rotational speed of about 3-10 rpm, which is less than the rotational speed of the impellor 86. However, the angle of the vanes 118 can be configured to rotatably drive the air deflector 84 in a direction opposite to the direction of the impellor 86 and up to a speed substantially equal to the rotational speed of impellor 86 without departing from the scope of the invention.

Outlet holes 132 formed through the impingent surfaces 128 of the vanes 118 reduce the rotational speed of the air deflector 84 while disrupting the flow of air exhausting from the centrifugal fan outlet 100. The size, shape, and number, if any, of outlet holes 132 is dependent upon the desired rotational speed of the air deflector 84 and the properties of the air flow exhausting from the centrifugal fan outlet 100.

Preferably, the air deflector 84 is rotatably mounted to the baffle 82 using an axial bearing 134 coaxial with the air deflector axis of rotation. The axial bearing 134 includes a stationary ring 136 and a rotatable ring 138. The stationary ring 136 is fixed to the baffle 82 using mechanical fasteners, such as bolts. The rotatable ring 138 is coaxial with the air deflector 84 and centrifugal fan 54, and fixed to the air deflector 84 using mechanical fasteners, such as bolts. Roller elements (not shown), or low friction pads, interposed between the rings 136, 138 allow the rotatable ring 138 to rotate relative to the stationary ring 136. Advantageously, inherent bearing drag in the axial bearing 134 maintains the rotational speed of the air deflector 84 below the rotational speed of the impellor 86. Of course, a bearing having a user settable bearing drag or structure frictionally engaging the air deflector 84 can be used to adjust the rotational speed of the air deflector relative to the rotational speed of the impellor.

The fan assembly 80 blows air over a heating element 142 disposed in the heating cavity 32 to maintain the desired air temperature therein. The heating element 142 in the embodiment described herein is an electrical resistance heating element. However, the heating element 142 can be heated using other methods, such as a gas heating element, without departing from the scope of the invention.

In use, the food product is placed in the heating cavity 32 and heated air is circulated around the food product by the centrifugal fan 54. The heated air radially exhausted by the centrifugal fan 54 through the fan outlet 100 is disrupted by the air deflector vanes 118 of the air deflector 84 passing over the fan outlet 100.

Advantageously, the air deflector described herein can be used in any temperature changing apparatus incorporating a centrifugal fan to minimize static pressure areas without departing from the scope of the invention. For example, the air deflector described herein can be incorporated in a refrigeration device including a refrigeration chamber including a cooling cavity having a fan. The air deflector can be mounted relative to the fan, as described above, to minimize static pressure areas and enhance the cooling efficiency of the refrigeration device.

INDUSTRIAL APPLICABILITY

The invention provides a continuously changing air flow path in an enclosure, such as a heating cavity of an oven incorporating heat convection.

The invention has been described in connection with what are presently considered to be the most practical and preferred embodiments. However, the present invention has been presented by way of illustration and is not intended to be limited to the disclosed embodiments. For example, the air deflector can be slippingly mounted on the impellor shaft or be mounted to rotate about an axis of rotation not coaxial with the impellor shaft without departing from the scope of the invention. Accordingly, those skilled in the art will realize that the invention is intended to encompass all modifications and alternative arrangements included within the spirit and scope of the invention, as set forth by the appended claims.

We claim:

1. A temperature changing apparatus, comprising:

a chamber defining a cavity that is configured to receive a food product therein;

a fan disposed in the cavity which circulates air in the cavity, said fan including a fan inlet through which the air is drawn into the fan and a fan outlet through which the air is exhausted from said fan; and an air deflector movably mounted relative to said fan, said air deflector including vanes having an impingement surface extending over said outlet and disrupting the air exhausted from said fan through said fan outlet as said air deflector moves relative to said fan to change the air flow path of the air exhausted from said fan.

2. The temperature changing apparatus as in claim 1, including a heating element disposed in the cavity, and said air circulated by said fan is heated by said heating element.

3. The temperature changing apparatus as in claim 1, in which at least one of said vanes includes an outlet hole formed through said impingement surface.

4. The temperature changing apparatus as in claim 1, in which a baffle is disposed in said cavity in front of said fan inlet.

5. The temperature changing apparatus as in claim 4, in which said air deflector is mounted to said baffle.

6. The temperature changing apparatus as in claim 4, in which said baffle includes an air inlet in front of said fan inlet.

7. The temperature changing apparatus as in claim 1, in which said fan includes an annular impellor having a center, and said fan inlet is formed in said center of said impellor.

8. The temperature changing apparatus as in claim 2, in which said heating element is an electrical resistance heating element.

9. A method of minimizing static pressure areas in a cavity containing a food product, said method comprising:

circulating air over a food product disposed in a cavity of a temperature changing apparatus using a fan exhausting a flow of the air through a fan outlet; and disrupting the flow of the air exhausting from said fan using an air deflector passing over said fan outlet.

10. The method as in claim 9, in which circulating the air includes rotatably driving an annular impellor of said fan, wherein said annular impellor draws the air into a fan inlet formed at a center of the impellor and exhausts the air radially through said fan outlet.

11. The method as in claim 9, in which disrupting the flow of the air exhausting from said fan includes rotatably driving said air deflector with the air exhausting from said fan.

12. The method as in claim 11, in which said air deflector includes at least one vane including an impingement surface extends over said fan outlet, and the air impinging on said impingement surface rotatably drives said air deflector.

13. The method as in claim 9, in which circulating the air includes drawing air into a fan inlet though an opening formed through said air deflector.

14. An oven, comprising:

an oven chamber defining a heating cavity that is configured to receive a food product therein;

a heating element disposed in the heating cavity;

a fan disposed in the heating cavity which circulates air in the heating cavity heated by said heating element; and an air deflector movably mounted relative to said fan and disrupting the air exhausted from said fan as said air deflector moves relative to said fan to change the air flow path of the air exhausted from said fan.

15. The oven as in claim 14, in which said fan is a rotatable fan including a fan inlet through which the air is axially drawn into the fan and a fan outlet through which the air is radially exhausted from said fan.

16. The oven as in claim 15, in which said air deflector is a rotatable air deflector including vanes having an impingement surface extending over said fan outlet and disrupting the air exhausted from said fan through said fan outlet.

17. The oven as in claim 16, in which at least one of said vanes includes an outlet hole formed through said impingement surface.

18. The oven as in claim 14, in which a baffle is disposed in said heating cavity in front of an air inlet supplying air to said fan.

19. The oven as in claim 18, in which said air deflector is mounted to said baffle.

20. The oven as in claim 19, in which said baffle includes an air inlet in front of said air inlet.

* * * * *